US006171157B1

(12) United States Patent
Knapp

(10) Patent No.: US 6,171,157 B1
(45) Date of Patent: Jan. 9, 2001

(54) PEDAL POWERED BOAT MOTOR

(76) Inventor: Mark Knapp, P.O. Box 10690, Fairbanks, AK (US) 99701

( * ) Notice: Under 35 U.S.C. 154(b), the term of this patent shall be extended for 0 days.

(21) Appl. No.: 09/569,444

(22) Filed: May 12, 2000

(51) Int. Cl.[7] ..... B63H 16/02
(52) U.S. Cl. ..... 440/25; 440/28
(58) Field of Search ..... 440/21, 24, 25, 440/28, 32

(56) References Cited

U.S. PATENT DOCUMENTS 1,082,698 * 12/1913 Master ..... 440/31
1,126,569 * 1/1915 Reynolds ..... 440/31
1,133,599 * 3/1915 Winzer ..... 440/31
2,084,321 * 6/1937 Corradino et al. ..... 440/25
3,211,125 * 10/1965 Yarbrough ..... 440/28
4,891,024 * 1/1990 Benjamin ..... 440/28
4,943,251 * 7/1990 Lerach et al. ..... 440/28

* cited by examiner

*Primary Examiner*—Jesus D. Sotelo
(74) *Attorney, Agent, or Firm*—Michael J. Tavella

(57) ABSTRACT

A pedal-powered boat that uses a flexible shaft to drive a propeller. By using a flexible shaft, the user's seat can be placed lower in the vessel, thereby increasing stability. The device also uses a pair of foot pegs and a ratcheted straight driver, which eliminates standard pedals, with their sweeping circular motion. This straight drive not only increases the efficiency of the leg power, it also converts the rotary action of the pedals to a linear motion that reduces the amount of space required to operate the unit. Thus, the driver unit can be placed under a seat so that it does not excessively intrude into the space of the boat.

7 Claims, 7 Drawing Sheets

PEDAL POWERED BOAT MOTOR

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to pedal powered boats and particularly pedal powered boats using a flexible drive shaft.

2. Description of Related Art

Pedal powered boats have been used for many years in many different situations. Many lakes or ponds in parks have small catamaran-type boats that users pedal leisurely around the pond. Although these boats are fun, they are not very practical, except as amusement.

Standard rowboats can be provided with a pedal-powered motor. These boats are used in areas where electric or gas engines are prohibited or where these types of propulsion are too noisy. Pedal power is silent. Moreover, it is also highly controllable at low speeds, such as those used during fishing. The operator can stop the boat quickly by not pedaling. Moreover, the operator can move a fair distance by pedaling, while still having full use of his or her hands.

Two designs of such pedal powered boats are found in U.S. Pat. Nos. 4,891,024 and 4,943,251. U.S. Pat. No. 4,891,024 to Benjamin shows a boat with a pedal propulsion system. The boat has a thwart that has a seat attached to it. The seat is positioned between a pedal crank system and the transom of the boat. The pedal crank system is attached to a frame that extends forward of the front of the thwart. The other end of the frame is supported by an adjustable post. The pedal system is connected to solid drive shaft that runs from the pedals to the transom. Universal joints in the shaft allow the shaft angle to be adjusted to accommodate the user. At the transom, it connects to a chain-drive motor. The chain drive extends down a shaft to a transmission and propeller. As the pedals turn the first shaft, it in turns rotates the chain drive, which in turn rotates the propeller. The second U.S. pat. No. 4,943,251 to Lerach et al, is a device uses a pedal and solid drive shaft that extends under a seat to a drive unit mounted on the stern of a canoe. This drive using uses gears to transfer the rotation of the drive shaft to the propeller. As in the case of the Benjamin patent, the solid drive shaft has a universal joint to allow the position of the shaft to be adjusted with respect to the seat. Both of these designs suffer from the same problem. Because they use solid shafts, the seats tend to be set high up near the top of the boat. This allows the shaft to extend from the pedal location to the top of the transom while running under the seat. Unfortunately small watercraft often require a low center of gravity to maintain stability. The high seat positions shown in these patents shift the center of gravity, making the boats unstable.

In addition, the use of a pedal and crank system to operate the propulsion system is inefficient. A straight leg thrust provides more power than the round leg motion used with pedals. The circular motion of the pedals requires a lot of space, both vertically and horizontally. The pedals must be placed high enough in the boat so that they clear the bottom of the boat. At the same time, the rotation forms a circle that extends forward and aft of the crank center. This circle may be obstructed by thwarts or seats, which must be removed to accommodate the range of motion needed for the pedals.

BRIEF SUMMARY OF THE INVENTION

The present invention overcomes the difficulties mentioned above. First, it uses a flexible shaft that eliminates the solid drive shafts found on the patents mentioned above. By using a flexible shaft, the seat can be placed lower in the vessel, thereby increasing stability. Second, it eliminates the pedals, with their sweeping circular motion, and replaces them with a pair of foot pegs and a ratcheted straight driver. This straight drive not only increases the efficiency of the leg power, it also converts the rotary action of the pedals to a linear motion that reduces the amount of space required to operate the unit. Thus, the driver unit can be placed under a seat so that it does not excessively intrude into the space of the boat.

DETAILED DESCRIPTION OF THE INVENTION

Figure 1:
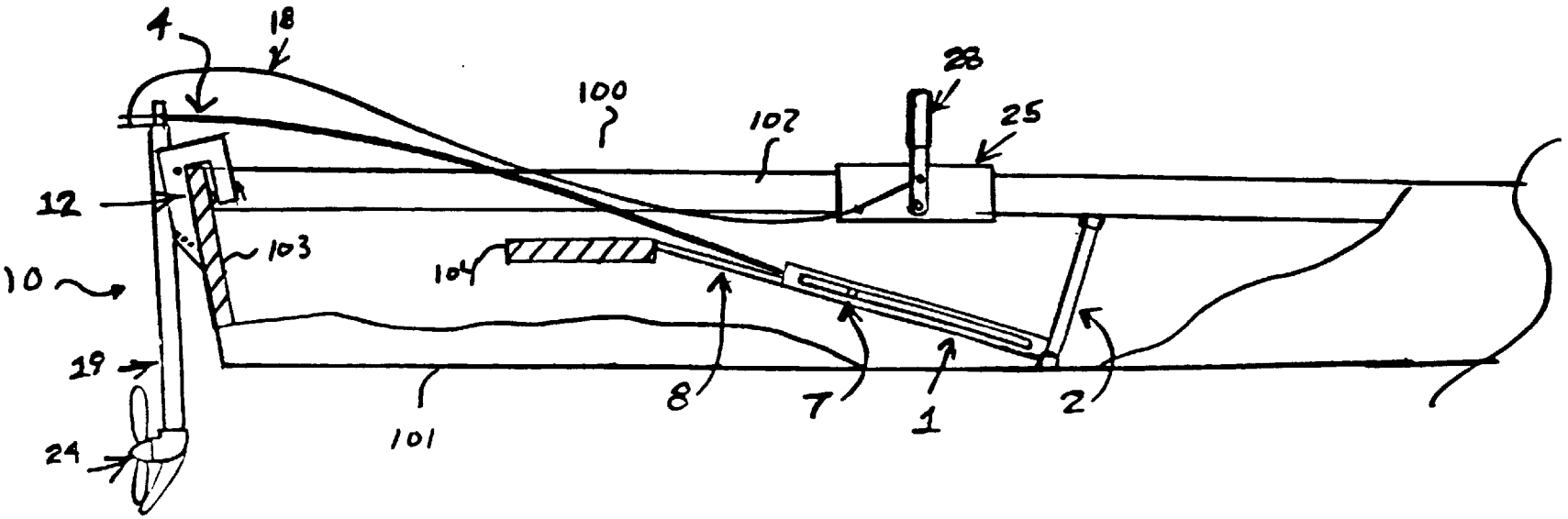
FIG. 1 is a partially cut-away side view of a boat showing the invention installed.

Referring now to FIG. 1, a portion of a typical small boat 100 is shown. The boat 100 has a bottom 101, a pair of gunwales 102, a transom 103 and a seat 104. FIG. 1 shows the instant invention in place in the boat. The invention has a treadle assembly 1, flexible drive shaft 4, a propeller drive unit 10 and a steering control assembly 25. A transom adapter assembly 30 is also provided for use in canoes and other vessels that lack transoms. This assembly is discussed below.

Figure 2:
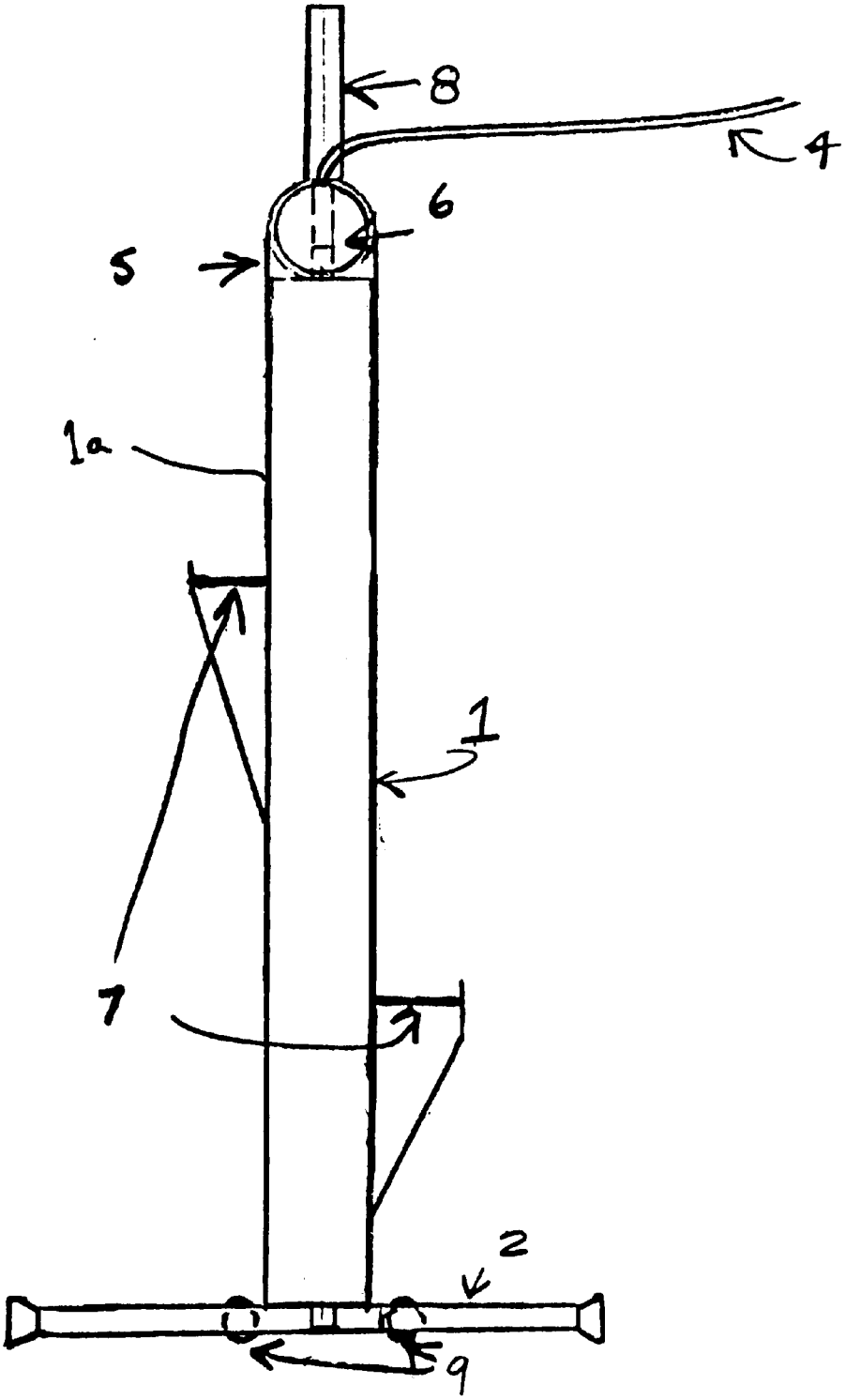
FIG. 2 is a side detail view of the treadle assembly.

FIG. 2 shows a side view of the treadle assembly 1. It has a frame 1*a*. Two side braces 2 are attached to one end of the treadle assembly 1 as shown. The side braces are telescopic and can be extended and angled to position the far end of the treadle assembly 1 in the center of a boat (see FIG. 1). Two feet 9 are attached to the far end of the treadle assembly to position the far end of the treadle assembly on the bottom of a boat. At the other end of the treadle assembly 1 is a telescopic strut 8 that extends from the treadle assembly to the forward part of the seat 104. The telescopic strut 8 is adjustable to adjust for operator leg length. This strut 8 is attached to the seat using any common fastening means.

Figure 3:
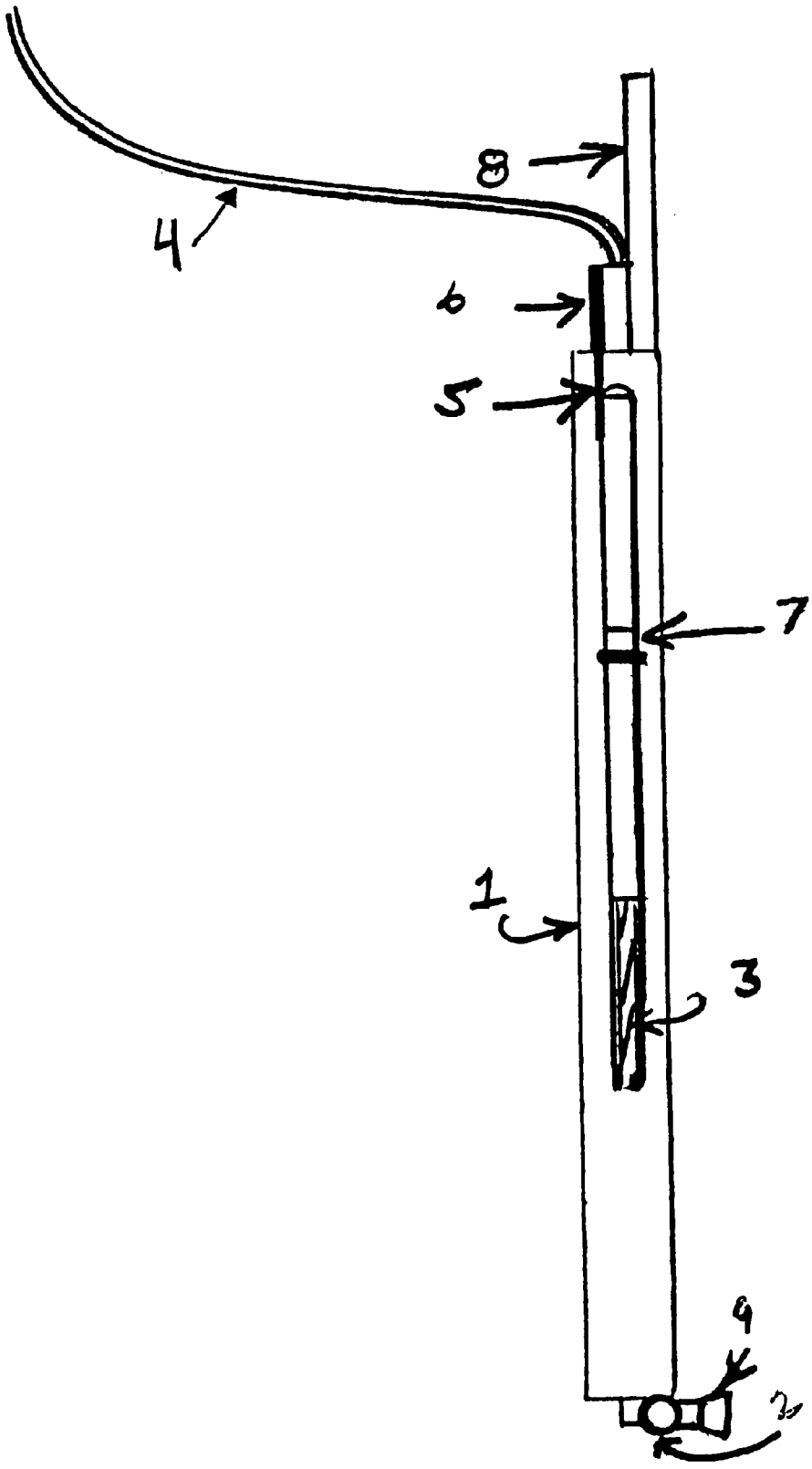
FIG. 3 is a top detail view of the treadle assembly.

Mounted within the frame 2 is a fluted or spiral spindle 3. This spindle is supported by bearings in the usual way. A pair of foot pegs 7 (see also FIG. 3) are attached to the spindle 3 with ratcheted hubs. This allows for a full power stroke in the outward direction and a free return. The foot pegs 7 are attached together by a cable 5 that runs over a pulley 6, as shown in FIG. 3. This cable allows for an automatic return of one foot peg while the other is on the down stroke. In this manner, the foot pegs are operated alternately, while producing full power on each stroke.

A flexible shaft 4 is attached to the spindle and is anchored to the frame 2 as shown. This shaft 4 transfers the power generated by the spindle to the outboard propeller drive unit 25.

Figure 4:
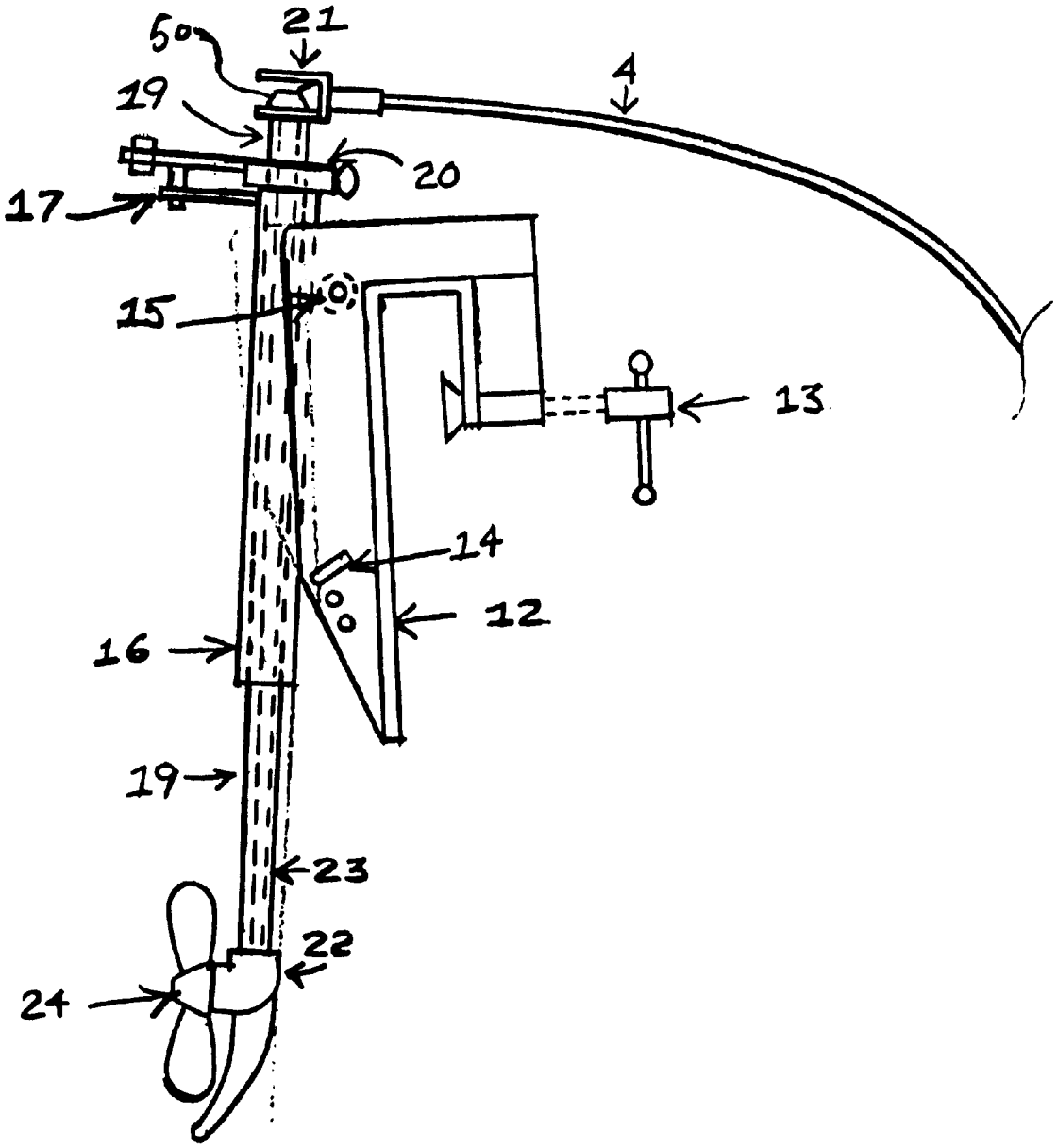
FIG. 4 is a side view of the outboard propeller drive unit.
Figure 5:
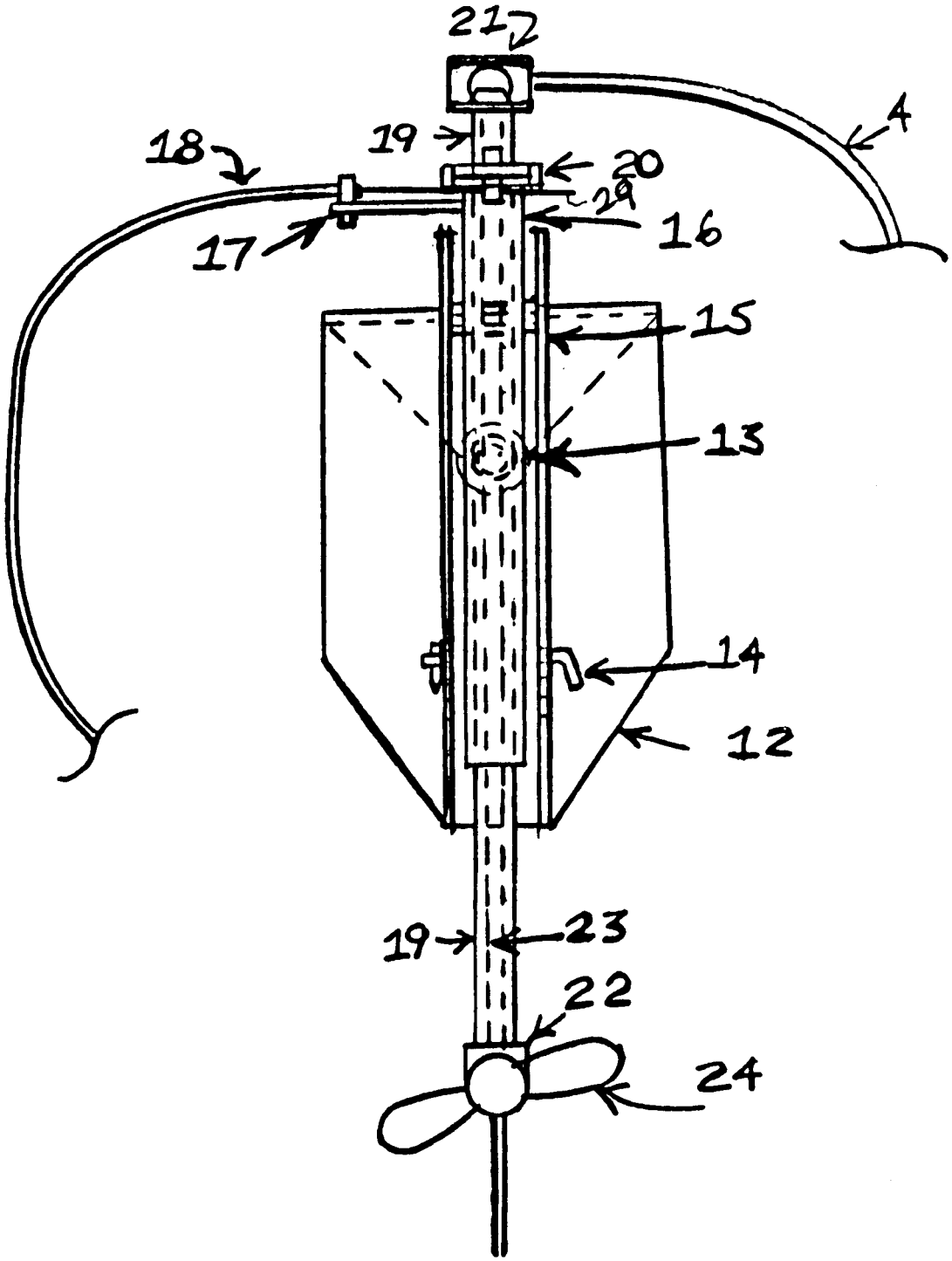
FIG. 5 is a back view of the outboard propeller drive unit.

Referring now to FIGS. 4 and 5, the outboard propeller drive unit 10 is shown. The drive unit 10 has a transom clamp 12, similar to those found to a typical outboard motor. The transom clamp 12 has a hand screw 13 to secure the clamp to the transom of the boat. A trim adjustment pin 14 is also provided as shown.

The propeller drive outer tube 16 is attached to the clamp 12 at hinge 15. A stationary steering arm 17 is attached to the top of the outer tube 16 as shown. The use of this arm is discussed below. A propeller drive main tube 19 is positioned within the outer tube 16 as shown. It is controlled by the actuated steering arm collar 20. The steering arm collar 20 adjusts the elevation of the propeller main drive tube 19 as well as transfers the rotational force from the flexible cable 4 to the propeller main drive tube 19.

Figure 6:
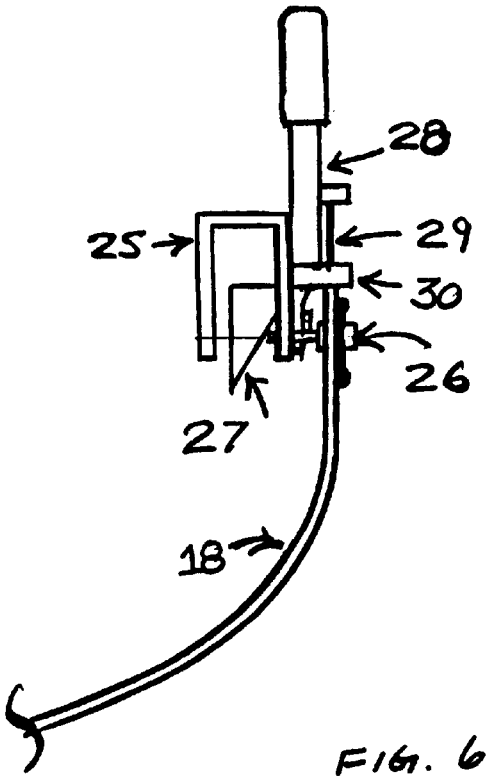
FIG. 6 is an end view of the steering control assembly.
Figure 7:
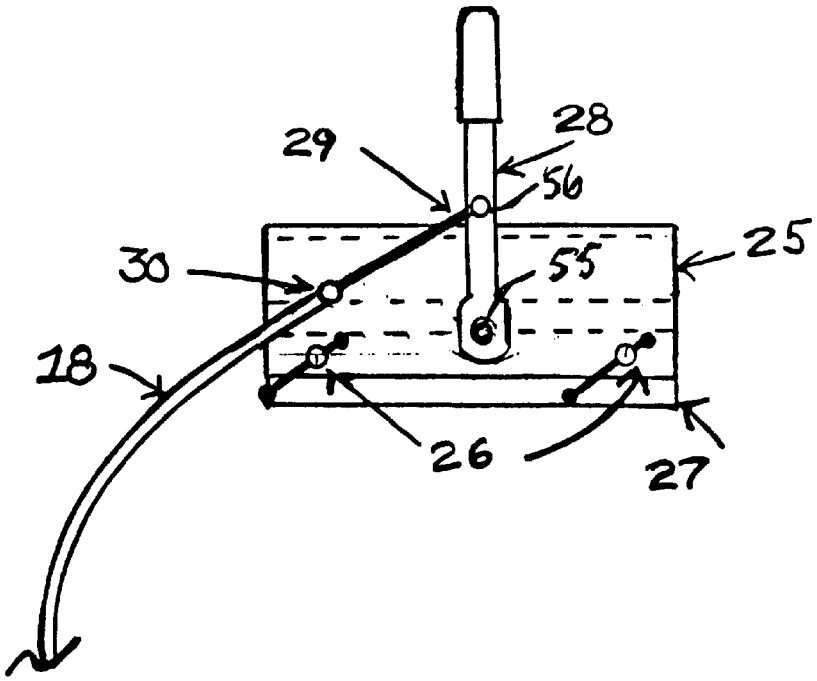
FIG. 7 is a side view of the steering control assembly.

At the top of the drive unit is an upper right-angle drive 21. Thus, drive converts the rotational horizontal force of the flexible shaft 4 to a vertical rotation. The upper drive uses gears 50 to convert the rotation. Of course, any other type of lightweight power converter may also be used. Power is then transferred to the lower portion of the drive unit by the main drive shaft 23 that runs inside the propeller drive main tube 19 as shown in FIG. 4. A lower right-angle drive unit 22 is positioned in the base of the drive unit. This unit converts the vertical rotation of the drive shaft 23 into horizontal rotation. A propeller 24 connects to the lower right angle drive unit 22. The propeller then rotates, driving the boat. The drive unit is designed so that the rotation can be in either direction. In this way, the boat can be driven backwards as well as forwards. Referring now to FIGS. 4–7, details of the steering system are shown. FIGS. 6 and 7 show the steering control assembly. This assembly has a gunwale clamp 25 that uses two hand screws 26 (see FIG. 7) and a wedge 27 (see FIG. 6) to secure the assembly to the boat. A steering handle 28 is attached to the gunwale clamp at a pivot point 55. The steering control cable 29 is attached to the handle at connection point 56. The steering control cable 29 is sheathed in an outer casing 18 as shown. The end of the outer casing is secured to the gunwale clamp at point 30*a* as shown. As shown in FIG. 5, the steering control cable attaches to the main drive tube 19. The outer casing 18 attaches to the stationary steering arm 17. When the steering handle 28 is pushed or pulled, it moves the steering cable 29, which in turn causes the drive tube 19 rotate. This movement then directs the movement of the boat in any desired direction.

Figure 8:
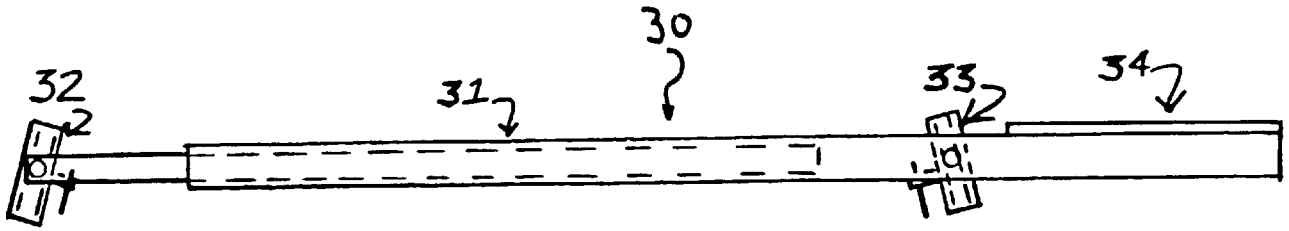
FIG. 8 is a top view of the transom adapter.
Figure 9:
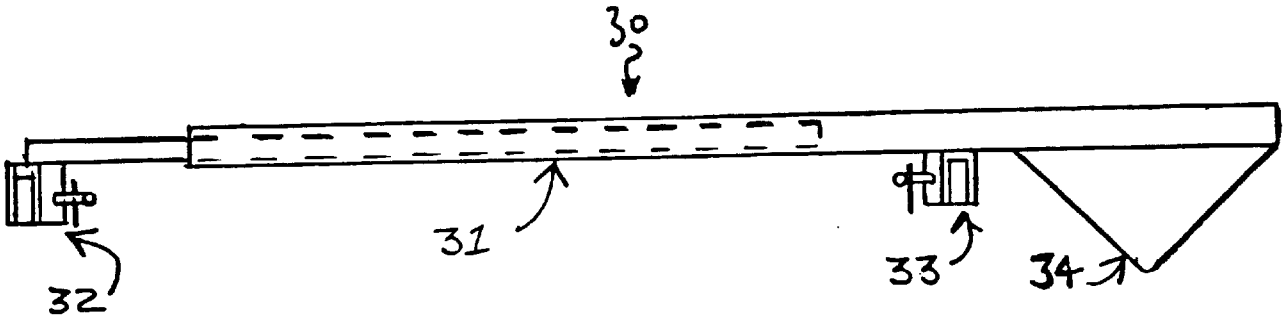
FIG. 9 is a front view of the transom adapter.

The device is designed to fit on any boat transom. For vessels that do not have transoms (such as canoes), a transom adapter is used. FIGS. 8 and 9 show the transom adapter. The adapter has an adapter thwart 31, which is telescopic to adjust to various beam widths. Port and starboard gunwale clamps 32 and 33 are attached to the thwart 31. The clamps are adjustable in angle to conform to variances in gunwale taper. The clamps 32 and 33 use hand screws and wedges, similar to those used on the steering control gunwale clamp 25. At one end of the thwart 31, outboard of the gunwale clamp is a transom plate 34. The plate is welded or attached using common fasteners. The drive unit can then be attached to the transom plate 34 in the same manner discussed above.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A pedal powered boat comprising:

a) a vessel, having a bottom, a pair of gunwales, a transom and a seat;

b) a treadle assembly, said treadle assembly having a fluted spindle, and pair of foot pegs attached to the fluted spindle, whereby reciprocating motion of said foot pegs, produces a rotational movement of said fluted spindle;

c) a propeller drive unit attached to the transom; and d) a flexible drive shaft, operably attached to said treadle assembly and said propeller drive unit, for transferring the rotational movement produced by said treadle assembly to said propeller drive unit.

2. The pedal powered boat of claim 1 further comprising a steering control assembly, operably attached to said propeller drive unit, for steering said pedal powered boat.

3. The pedal powered boat of claim 1 further including a transom adapter assembly for use in canoes and other vessels that lack transoms.

4. The pedal powered boat of claim 1 wherein treadle assembly further includes:

a) a cable, attached to said pair of foot pegs; and b) a pulley, attached to said treadle assembly, whereby said cable passes over said pulley such that the cable allows for an automatic return of one of said pair of foot pegs while the second of said pair of foot pegs is on a down stroke, such that said pair of foot pegs being operated alternately, while producing full power on each stroke.

5. The pedal powered boat of claim 1 wherein treadle assembly further includes:

a) a frame;

b) side braces, attached to a first end of the treadle assembly, the side braces being telescopic;

c) a pair of feet, attached to said first end of the treadle assembly, to position the first end of the treadle assembly on the bottom of said pedal powered boat.

6. The pedal powered boat of claim 5 wherein said treadle assembly further includes a telescopic strut, attached to a second end of said treadle assembly, whereby said telescopic strut extends from the treadle assembly to the seat of said pedal powered boat.

7. The pedal powered boat of claim 1, wherein said propeller drive unit includes a means for transferring said rotational movement of said flexible drive shaft, to a propeller, operably attached to said propeller drive unit.

* * * * *